United States Patent [19]

Dunn, Jr. et al.

[11] 4,193,509

[45] Mar. 18, 1980

[54] CLOSURE HAVING HIGH RETENTION TORQUE CHARACTERISTICS

[75] Inventors: C. E. Lee Dunn, Jr., Toccoa; Carl A. Miller, Cornelia, both of Ga.

[73] Assignee: The AFA Corporation, Miami Lakes, Fla.

[21] Appl. No.: 938,198

[22] Filed: Aug. 30, 1978

[51] Int. Cl.[2] ..... B65D 41/04

[52] U.S. Cl. ..... 215/330

[58] Field of Search ..... 215/229, 230, 231, 216; 220/288, 289

[56] References Cited

U.S. PATENT DOCUMENTS

| | | | |
|---|---|---|---|
| 1,582,429 | 4/1926 | Podel | 215/330 |
| 2,770,382 | 11/1956 | Ritter | 215/329 |
| 3,297,185 | 1/1967 | Plymale | 215/330 |
| 3,405,831 | 10/1968 | Hudson | 215/330 |
| 3,511,403 | 5/1970 | Braun | 215/330 |
| 3,620,400 | 11/1971 | Braun | 215/330 |
| 3,682,345 | 8/1972 | Bauch | 215/330 |
| 3,727,784 | 4/1973 | Sargent | 215/329 |
| 3,913,772 | 10/1975 | Ochs | 215/330 |
| 3,987,921 | 10/1976 | Aichinger | 215/329 |
| 4,129,228 | 12/1978 | Stoneback | 215/329 |

*Primary Examiner*—George T. Hall

*Attorney, Agent, or Firm*—Stanley A. Marcus; William R. Wright, Jr.

[57] ABSTRACT

A threaded closure for a standard threaded container is provided wherein the closure's removal torque retention qualities are improved by the provision of a portion or portions of its thread which have an increased thread depth and which bear upon the neck of the container and thus provide extra friction to retain the closure.

17 Claims, 5 Drawing Figures

CLOSURE HAVING HIGH RETENTION TORQUE CHARACTERISTICS

Threaded closure caps for bottles or other types of containers all share the common problem of providing and sustaining sufficient removal torque to maintain both a seal between the container and the cap and to prevent inadvertent unscrewing of the cap with possible loss of the container's contents during shipping for instance, or, actual separation of the cap and container with possible loss of the cap entirely. Most caps in the past have relied solely on the pressure of the mating threads upon one another to provide an overall downward force between the cap and the container top and to provide sufficient friction between the threads to keep the cap in place and to maintain a seal between the cap and container. With this arrangement, the caps are usually tight initially but tend not to stay that way due to dimensional changes of the material involved in the cap particularly where the material creeps or becomes relaxed.

One attempt to solve this problem is presented in U.S. Pat. No. 3,295,708 to J. M. Wathen, Jr. wherein the inventor provides a "lug" on the upper most thread on the container neck which cooperates with a recess in the cap to act as a locking mechanism and thus to retain the cap in place. The present invention represents an improvement over this showing in a number of ways among which is the fact that the increased thread depth portions of the present invention do not come into action until the cap is screwed almost all the way down onto the container whereas the Wathen device comes into action as soon as the cap is started on the top thread of the container, making it more difficult to screw it on all the way down due to the increased friction. Also, it is noted that placement of Wathen's lug on the cap as mentioned in his specification would mean that the lug would be placed on the lowest thread of the cap since it is logical to assume that the same relationship would be followed. This would again mean that the retention friction would be present substantially during the entire screwing on of the cap. Friction of this sort makes it difficult for the user to remove or replace the cap and can discourage him or her from tightening the cap fully with the result that a proper seal is not attained between the cap and container.

In addition to the foregoing, the "recess" used by Wathen to retain the lug must be located very exactly since even a small variation in its location can prevent the lug from entering it just as the sealing effect between the cap and container are realized so that the torque retention feature is only partially effective or not effective at all. For instance, if the lug enters the recess too early the user may assume from the feel that the cap is sealed on the container whereas it may not be, and, conversely if it enters the recess too late it will enter only partially and not be fully effective for torque retention purposes. This criticality of location problem is solved in the present invention since increased thread depth portions of some length are used as described later in this specification and no "recess" is required thus eliminating the need for such a critical location.

Other attempts have been made to retain screw closures on a container by means of positive catch arrangements such as are shown in U.S. Pat. No. 4,084,716 to Clayton Bogert and in U.S. Pat. No. 4,084,717 to Roderick V. King. In the first of these (U.S. Pat. No. 4,084,716), a safety closure of the screw-threaded closed top and linerless type includes "axially extended serrations" formed in the thread of the cap near the thread's lower or entry end. These are intended to engage similar serrations on the matching threads on the neck with the serrations on the neck also located near the lower end of its thread. In the second patent (U.S. Pat. No. 4,084,717), a "ratchet portion" is included in the "container threads" at their start ends and a ratchet tooth is included separate from the closure threads and adjacent their terminal ends. The tooth on the closure engages the ratchet portion on the container to prevent removal of the closure and the ratchet must be disengaged by the operation of a flex means in order that the closure may be removed. Neither of these devices solve the problem in the same way as is shown in the present invention, and appear to be more difficult to use since the ratchet-like mechanisms employed in each must be freed either by an additional motion or by overpowering of the serrations, and, both require modification of the container itself whereas the present invention applies to the closure only which can be used on any container having matching standard and unmodified threads.

It is also noted that the distribution of the load between the closure and the container is evenly distributed across the closure in the present invention resulting in less unit pressure on the cap in the area of the removal torque retention means and resulting in less possibility of cap distortion and consequent possible loss of sealing capability.

It is also expected that the present invention may be less expensive to make since only minor variations are needed in the dies from which ordinary caps are formed.

Another important advantage of the present invention lies in the fact that the cap will fit any container having matching standard threads without modification of the container which would not be the case with the devices shown in the above-mentioned patents wherein both the cap and the container require modification.

It is, therefore, an object of the present invention to provide a closure or cap for a container with the closure or cap having improved removal torque retention characteristics.

It is also an object of the present invention to provide a screw closure or cap of the foregoing type wherein the torque retention means does not interfere with the free installation and removal of the cap except for a partial last turn during installation and an initial partial turn during removal.

It is also an object of the present invention to provide a closure or cap having improved torque retention characteristics but which does not require modification of the standard threaded container to which it is to be attached.

It is also an object of the present invention to provide a closure or cap for a container wherein the closure provides for an even distribution of load across the closure and thus prevents distortion thereof with possible loss of its sealing qualities.

It is also an object of the present invention to provide a closure of the foregoing type which is simple and relatively inexpensive to manufacture.

It is also an object of the present invention to provide a closure of the foregoing type which does not necessitate critical dimensioning of the removal torque retention means.

Other objects and advantages of the present invention will become apparent from the description and claims which follow.

DETAILED DESCRIPTION OF THE INVENTION AND ITS OPERATION

Figure 1:
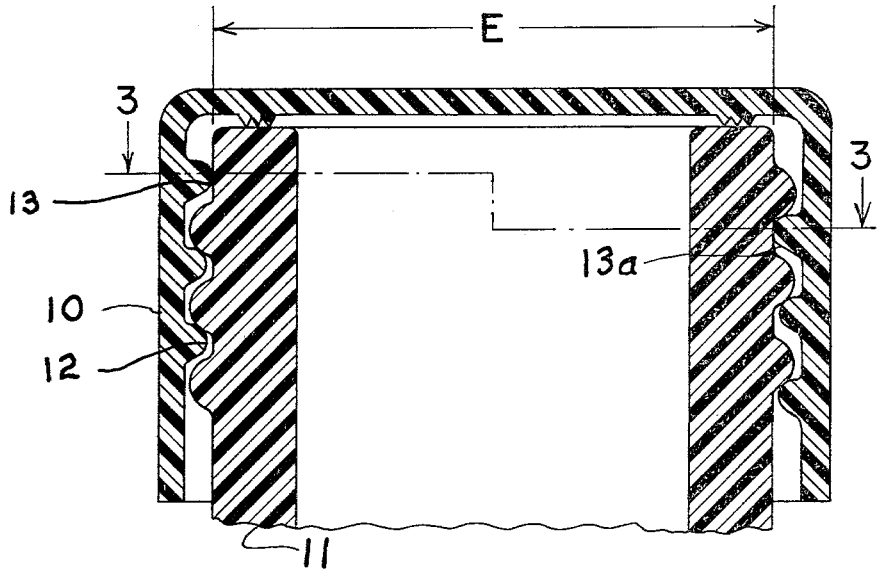
FIG. 1 is a cross sectional elevation of a closure comprising the present invention and showing the increased thread depth portion of the attaching thread.
Figure 4:
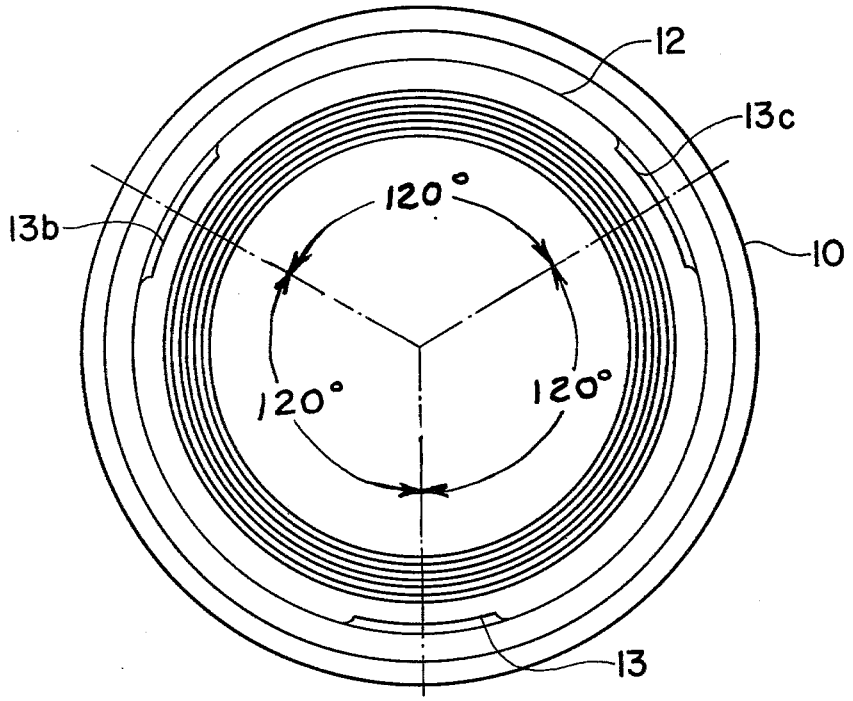
FIG. 4 is a view looking upward into the closure with the container removed and showing three increased depth portions spaced substantially 120 degrees apart.
Figure 5:
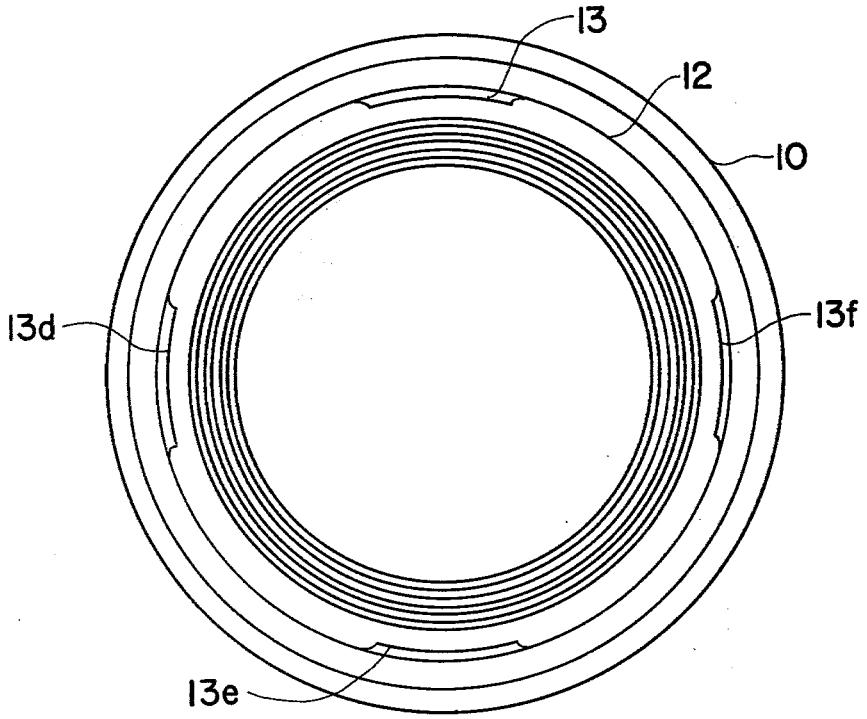
FIG. 5 is a view looking upward into the closure with the container removed and showing four increased depth portions spaced substantially 90 degrees apart.

In a preferred embodiment of the invention, and with reference to FIG. 1 of the drawings in particular, a closure or cap 10 for a container 11 such as a standard necked bottle is shown having threads 12 which match those on the neck of container 11 as is customary with standard closure caps or containers so that the cap 10 can be screwed onto the container 11 in the usual fashion. An important feature is included, however, in that the uppermost thread has a portion 13 which is increased in depth near its terminus and which extends along it for about one-sixteenth of a turn or the arc subtended by about 20 degrees as shown in FIG. 4. In addition, a second portion 13*a* of the same thread, similarly increased in depth, is located approximately 180 degrees from the location of the first deeper portion, i.e. opposite thereto. Both of these are substantially identical in form in both length and cross section and serve the purpose of counteracting the forces created by each as they are forced against the container's neck, i.e. its "E" dimension as shown in FIG. 1. This diametrically opposed disposition of the portions of increased depth results in even distribution of the load across the closure so that it will not be pushed to one side and distorted with possible disruption of the seal.

While the length of each portion of increased depth is preferably the length of the arc subtended by a 20 degree angle, it is expected that this could vary between the angles of 15 degrees to 25 degrees without producing undue friction that would neither make it too difficult to unscrew the cap nor reduce the friction so the cap would not be retained properly due to too little friction. For instance, as a typical example of the present invention, a cap having a normal, standard thread which is 0.045 inches in depth could have an increased thread depth portion or portions wherein the depth is increased to 0.060 inches, and, would have an increased depth portion length of about ⅜ths of an inch. The overall outside diameter of the cap in this instance would be about 2 inches.

The depth of the thread referred to in this specification is always that measured from the root of the standard thread wherein the root is located at a constant radial distance, or radius, from the central axis of the closure. Since the closure will have at least an internal cylindrical form on which the thread is provided, the central axis will also be its cylindrical axis from which the radii emanate.

Figure 2:
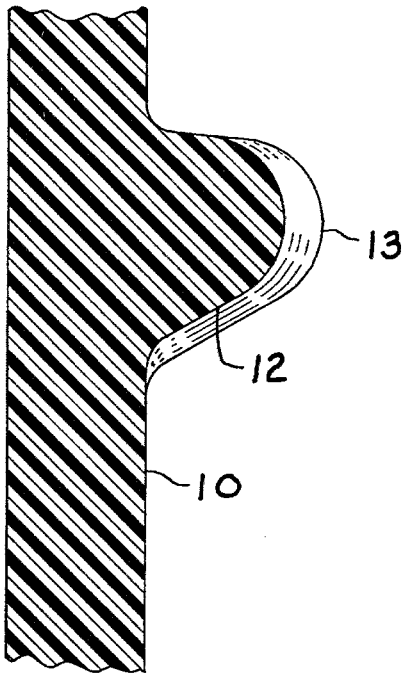
FIG. 2 is an enlarged partial cross sectional view of the final or uppermost attaching thread of the closure only and looking in the direction of torque retention increased depth thread.
Figure 3:
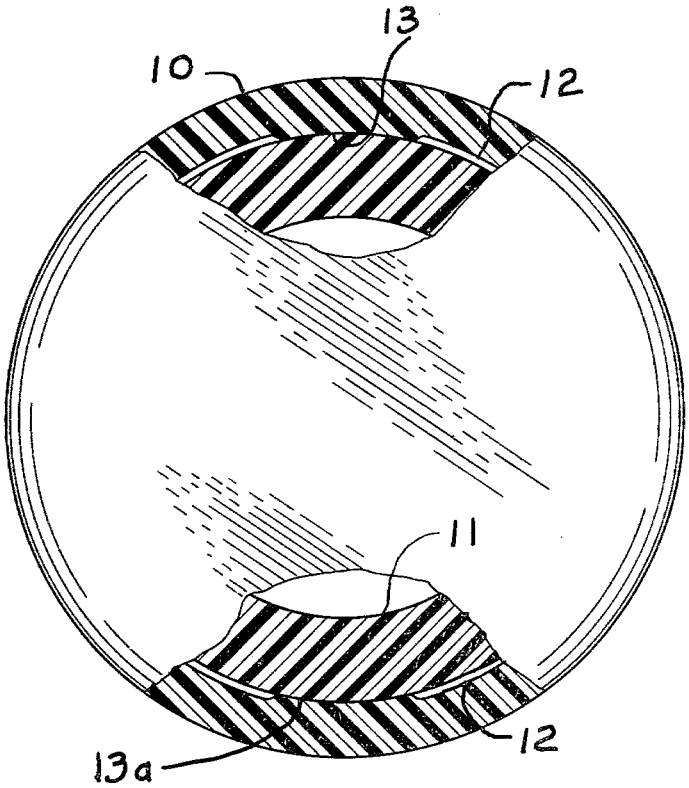
FIG. 3 is a cross sectional plan view of the closure taken in the direction of the arrows 3—3 in FIG. 1 and showing oppositely disposed increased depth portions of the attaching thread.

As will be seen in the drawings, particularly in FIG. 2, the increased thread depth portion 13 is located on the inner periphery of the thread 12 so that it will come in contact with the container's neck (dimension E) and will press against it with a force greater than the force, if any, exerted by the remainder of the thread without the increased thread depth portion. Thus, as the cap 10 is screwed in place on the neck of the container 11, the threads of the cap 10 press upwardly against the threads of the container 11 but as the increased thread depth portion 13 of the cap thread comes into contact with the neck of container 11 and slides upon it until it is fully in contact, considerably more friction is created between the neck and the increased thread depth portion 13 with the result that the cap 10 becomes tightly held in place. This action ocurrs at the same time that the cap's top and the container's neck rim come into contact in a sealing manner and they are thus retained in that relationship by the tight friction of the thread portion of increased depth against the side of the neck of the container 11. Diametrically opposed increased depth portion 13*a* also acts in a similar manner and, in addition, helps to distribute the load forces on the cap 10 more evenly.

While the friction force created is intended to be sufficient to maintain the cap 10 and container 11 in the aforementioned relationship, it is not intended to be so large as to make it too difficult for a person to unscrew the cap 10 nor to screw it back on the container 11. With this in mind, the portion of the thread with increased depth is dimensioned such that this will be the case, and this is accomplished by making the thread's portion of increased depth deeper than the maximum depth of the remainder of the thread by not less than 20 and not more than 25 percent of the original depth.

It is not intended that the present invention be limited to a showing of only one or two portions of increased depth since additional such portions can be used also. For instance, three can be provided as shown in FIG. 4 as designated by numerals 13, 13*b* and 13*c*, in which case the portions are located on the uppermost thread (that closest to the closed top) approximately 120 degrees apart so that the force exerted on the closure will be substantially evenly distributed across it. Again, in FIG. 4, four portions of increased depth are shown spaced approximately 90 degrees apart with the force exerted on the closure substantially evenly distributed because of the equal spacing. Other arrangements of multiple portions of increased depth, or even a continuous thread of up to one or more turns can be used if desired but the extra friction created when the cap is installed, additional material used in manufacturing and possible increased die costs tend to make these arrangements relatively impractical. They are, nevertheless, considered to be within the scope and spirit of the present invention.

The cap 10 is preferably made of a molded plastic material such as polypropylene but could be made of other plastic materials used in the manufacture of closures.

While there have been shown and described and pointed out the fundamental novel features of the invention as applied to a preferred embodiment, it will be understood that various omissions and substitutions and changes in the form and details of the device illustrated and in its operation may be made by those skilled in the art, without departing from the spirit of the invention. It is the intention, therefore to be limited only as indicated by the scope of the following claims.

What is claimed is:

1. A threaded cylindrical closure, having a closed top, for a standard threaded container, said closure having a first portion of the closure's thread increased in depth, the base of said thread being at a substantially constant radial distance from the cylindrical axis of said closure, and the said portion located on the closure on its uppermost thread with respect to the closure's top.

2. The invention set forth in claim 1 wherein a plurality of portions of the thread are increased in depth.

3. The invention set forth in claim 2 wherein the said portions are spaced circumferentially about the thread.

4. The invention set forth in claim 3 wherein the said portions are equally spaced circumferentially about the thread.

5. The invention set forth in claim 1 wherein a second portion of its thread is increased in depth.

6. The invention set forth in claim 2 wherein the second portion is located substantially 180 degrees from the first portion.

7. The invention set forth in claim 1 wherein the length of the said first portion is less than one half of a full turn of the thread.

8. The invention set forth in claim 2 wherein the length of the said second portion is less than one half of a full turn of the thread.

9. The invention set forth in claim 1 wherein the thread has a terminus, the said first portion being adjacent its terminus.

10. The invention set forth in claim 1 wherein the length of the said first portion is substantially equal to the length of the arc subtended by a radial angle of about 15 to 20 degrees inclusive.

11. The invention set forth in claim 2 wherein the length of the said second portion is substantially equal to the length of the arc subtended by a radial angle of about 15 to 20 degrees inclusive.

12. The invention set forth in claim 1 wherein the depth of the said first portion is increased to about 20 percent of about 25 percent greater than the depth of the remainder of the thread.

13. The invention set forth in claim 2 wherein the depth of the said second portion is increased to about 20 percent to about 25 percent greater than the depth of the remainder of the thread.

14. The invention set forth in claim 2 wherein three portions of the thread are increased in depth.

15. The invention set forth in claim 14 wherein the said three portions are equally spaced circumferentially about the thread.

16. The invention set forth in claim 2 wherein four portions of the thread are increased in depth.

17. The invention set forth in claim 16 wherein the said four portions are equally spaced circumferentially about the thread.

* * * * *